United States Patent [19]

Noda et al.

[11] 3,958,915

[45] May 25, 1976

[54] METHOD OF BURNING EMULSION OILS

[75] Inventors: Hideyo Noda, Kyoto; Norio Kawai, Osaka; Osamu Tarue, Nagaokakyo; Kazuo Fukada, Takarazuka; Sigeyoshi Idehara, Akashi; Tadao Nakanishi, Osaka; Yuzo Kakimoto, Akashi; Yoshito Nakamura, Ibaraki, all of Japan

[73] Assignees: The Toyo Rubber Industry Co., Ltd., Osaka; Kawasaki Jukogyo Kabushiki Kaisha, Kobe, both of Japan

[22] Filed: Feb. 11, 1975

[21] Appl. No.: 548,994

[30] Foreign Application Priority Data

Feb. 15, 1974 Japan ..... 49-19007
Feb. 15, 1974 Japan ..... 49-19008

[52] U.S. Cl. ..... 431/9; 431/2; 431/4; 431/10

[51] Int. Cl.[2] ..... F23J 5/02

[58] Field of Search ..... 431/2, 4, 190, 9, 115, 431/116, 10

[56] References Cited

UNITED STATES PATENTS

| | | | |
|---|---|---|---|
| 3,741,712 | 6/1973 | Delatronchette | 431/190 |
| 3,749,318 | 7/1973 | Cottell | 431/4 X |
| 3,766,942 | 10/1973 | Delatronchette | 431/4 X |
| 3,901,644 | 8/1975 | Armas | 431/4 X |

*Primary Examiner*—Edward G. Favors
*Attorney, Agent, or Firm*—Armstrong, Nikaido & Wegner

[57] ABSTRACT

An emulsion oil containing oil and water in a ratio of 5 – 9.5:5 – 0.5 by volume is burned by two-stage combustion method or by the combination of two-stage combustion method and exhaust gas recirculation method.

16 Claims, 4 Drawing Figures

METHOD OF BURNING EMULSION OILS

This invention relates to a method of burning oils, and more particularly to an improved method of burning emulsion oils.

Researches have been made on methods of controlling or removing soot and nitrogen oxide emissions which are sources of air pollution.

Heretofore known as methods of controlling nitrogen oxide emissions are: (1) improvements of burning oil as it is such as a combustion method using a reduced amount of air, two-stage combustion method, exhaust gas recirculation method, etc.: (2) combustion methods using improved oils such as emulsion combustion methods, etc.

However, none of the known methods are fully effective in reducing nitrogen oxide emissions and the method using a reduced amount of air and the two-stage combustion method give a larger amount of soot during combustion. Further when burning oils containing nitrogen constituents, it is more difficult to burn the oils controlling soot as well as nitrogen oxide emissions. Because nitrogen constitutents contained in oils cause the marked formation of nitrogen oxide emissions and if it is attemped to burn the oils under the conditions capable of reducing the amount of nitrogen oxide emissions to an allowable level, the amount of soot greatly increases.

In recent years, there is a tendency for more stringent regulations on pollution; for example the exhaust standards are set for soot and nitrogen oxides with ever increasing severity. It is therefore strongly demanded to develop a method of more effectively controlling these substances.

An object of this invention is to satisfy this demand and to provide a method of burning oils which is capable of remarkably reducing nitrogen oxide emissions as compared with conventional method and, at the same time, mitigating formation of soot to a negligible extent.

Another object of this invention is to provide a method of burning oils which is capable of remarkably reducing nitrogen oxide emissions as compared with conventional methods and, at the same time, mitigating formation of soot to a negligible extent, even when the oils contain nitrogen constituents.

In burning an emulsion oil containing oil and water in a ratio of 5 – 9.5 : 5 – 0.5 by volume, the method of this invention is characterized in that the emulsion oil is burned by two-stage combustion method or by the combination of two-stage combustion method and exhaust gas recirculation method.

Researches have revealed that when used for burning oil as it is, two-stage combustion method permits marked formation of soot if it is attempted to reduce nitrogen oxide emissions, whereas the method fails to satisfactorily diminish nitrogen oxide emissions under the conditions capable of reducing the amount of soot to an allowable level. More specifically, with the decrease in the amount of primary air, nitrogen oxide emissions reduce, but a greater amount of soot results. In order to reduce soot to a negligible extent, accordingly, the ratio of the amount of primary air to the theoretically required amount of air must be at least 0.9. Under this condition, however, it is unable to control nitrogen oxide emissions to an acceptable level as will be apparent, for example, from the results of Example 3 (see Table 3, Experiments No. 4 to No. 7).

We have found that the combination of emulsion combustion method and two-stage combustion method, when practiced, permits combustion of oil free of the foregoing drawbacks, namely with reduced nitrogen oxide emissions and with a substantially reduced amount of soot. We have further found that emulsion combustion method, two-stage combustion method and exhaust gas recirculation method, when practiced in combination, reduce nitrogen oxide emissions and soot more effectively than is the case with the former.

According to this invention, oils which are liquid at room temperature, immiscible with water and flammable are used for combustion. Examples are gasoline, kerosene, gas oil, fuel oil, naphtha, benzene, toluene, process oil, spindle oil, machine oil, lubricating oil and like mineral oils; fish oil, whale oil, linseed oil, sesame oil, soybean oil, castor oil and like animal and vegetable oils, etc. The fuel oil herein used is classified into 3 types as follows according to JIS K 2205–1960 and all types are usable for the present invention.

| Type of fuel oil | Flash point (°C) | Kinematic viscosity at 50°C (st.) |
|---|---|---|
| Fuel oil - A | >60 | <20 |
| Fuel oil - B | >60 | <50 |
| Fuel oil - C | >70 | 50 –400 |

These oils are used singly, or at least two of them are used in admixture. Among these oils, fuel oil — B and fuel oil — C contain nitrogen constituents, which, when burned by conventional methods, yield amounts of nitrogen oxides larger than negligible levels. However, this invention can effectively reduce both nitrogen oxides and soot even when burning these oils. This is a distinct feature of this invention.

For the preparation of emulsion oil according to this invention, water is mixed with oil in an amount effective in reducing nitrogen oxides without entailing a great head loss due to the evaporation of water. The ratio by volume of oil to water is usually 5 – 9.5 : 5 – 0.5, more preferably 7 – 9 : 3 – 1. The ratio of less than 5 : 5 involves difficulties in effecting continuous burning, entailing a great heat loss due to the evaporation of water. When the ratio is more than 9.5 : 0.5, sufficient reduction of the soot and the nitrogen oxide emissions will not be achieved.

To improve the ignitability of the emulsion oil to be prepared, the water to be mixed with oil may be partially replaced by aliphatic alcohol having 1 to 3 carbon atoms such as methanol, ethanol, propanol, ethylene glycol or glycerin. Among these alcohols preferable are methanol, ethanol and propanol. These alcohols are used singly, or at least two of them are usable in admixture. It is generally suitable to replace water by the alcohol in an amount of up to 10%, preferably 0.01 to 3%, based on the volume of water from the viewpoint of cost.

When desired to prepare the emulsion oil with ease, a surfactant may be added to the ingredients. Usable as the surfactant is any of anionic, cationic and nonionic surfactants, among which nonionic surfactants which consist of carbon, hydrogen and oxygen atoms are preferable. The amount of surfactant to be used is generally 0.01 to 5% by volume based on emulsion oil to achieve good results. To stabilize the emulsion, the emulsion oil may further contain a stabilizer such as polyvinyl alcohol, carboxymethyl cellulose, sodium alginate or the like. The amount of the stabilizer to be used is usually 0.1 to 5% by volume, preferably 0.1 to 1% by volume, based on water.

The emulsion oil is prepared in a conventional manner. It can be prepared, for example, by mixing oil and water. Surfactant and/or emulsion stabilizer, when used, are preferably dissolved in water or oil before mixing. For the preparation of emulsion, various mixers are usable such for example as dissolver, homomixer, colloid mill, ultrasonic homogenizer, etc.

Whether the emulsion oil obtained is of the oil-in-water type or of the water-in-oil type depends on the kind of surfactant, the ratio of oil to water, stirring method, etc. Both types of emulsion oils can be used according to this invention. The sizes of the particles suspended in the emulsion are preferably 0.1 to 50 $\mu$, more preferably 0.1 to 20 $\mu$. The viscosity of the emulsion, which is dependent on the ratio of oil to water, particle size, the molecular weight and proportion of surfactant, etc., is usually not higher than 5,000 cps./60°C, preferably up to 500 cps./60°C.

According to this invention, it is critical that emulsion oil be burned by two-stage combustion method or by the combination of two-stage combustion method and exhaust gas recirculation method.

The present method can diminish the formation of soot to a negligible extent and, at the same time, greatly reduce nitrogen oxide emissions and is very useful in burning oils containing nitrogen constituents.

With two-stage combustion method, oil is burned with part of combustion air supplied to the burner as primary air and with the remainder of the combustion air supplied at a position some distance away from the burner as secondary air. In the two-stage combustion method of this invention, the amount of primary air is generally 30 to 105 vol. %, preferably 40 to 90 vol. %, based on the theoretically required amount of air, and the amount of secondary air is generally 15 to 200 vol. %, preferably 25 to 100 vol. %, based on the theoretically required amount of air. With amounts of primary air less than 30 vol.%, the reduction of nitrogen oxide emissions levels off, and larger amounts of soot will result. If the amount of primary air exceeds 105%, nitrogen oxide emissions will increase. With amounts of secondary air less than 15 vol. %, sufficient reduction of nitrogen oxide emissions will not be achieved and with more than 200 vol. %, a great head loss due to the air will occur.

In the exhaust gas recirculation method to be practiced in combination with two-stage combustion method, part of exhaust gas is recirculated, as mixed with fresh air, to the combustion chamber adapted for the latter method. According to the exhaust gas recirculation method, the heat capacity of combustion gas increases to lower the maximum flame temperature. The low flame temperature and reduced oxygen concentration synergically serve to reduce nitrogen oxide emissions. The amount of the exhaust gas to be recirculated is generally 10 to 40 vol. %, preferably 15 to 30 vol. %, based on the exhaust gas produced. With the amount of exhaust gas less than 10%, efficient reduction of nitrogen oxide is unattainable, whereas if it is in excess of 40%, a larger combustion chamber becomes necessary since complete combustion is not available.

With emulsion combustion method, emulsion oil is burned as diffused or atomized from a nozzle. Usually steam, air or pressure is used as means for diffusing or atomizing the emulsion oil. When steam or air is used, a nozzle of double construction, for example, is employed. Emulsion oil fed through one tube and steam or air passed through the other tube are forced out from the end of the nozzle to atomize the emulsion oil. When pressure is employed, emulsion oil is forced out in atomized state from the end of a nozzle equipped with a tip for the application of pressure. For atomization, steam is used in an amount usually of 2 to 50 wt.%, preferably of 5 to 30 wt.%, based on the volume of oil. The air to be used for atomization has pressure of 0.01 to 20 kg/cm$^2$ gauge, preferably 1 to 8 kg/cm$^2$ gauge. With pressure atomization method, the pressure is usually 0.01 to 100 kg/cm$^2$ gauge, preferably 1 to 50 kg/cm$^2$ gauge.

According to this invention, emulsion oil is burned by two-stage combustion method or by the combination of two-stage combustion method and exhaust gas recirculation method. In both cases, the total amount of combustion air (primary air plus secondary air) to be used is eventually in an excess ratio to the theoretically required amount of combustion air of 1.0 to 3.0, preferably 1.1 to 1.9, more preferably 1.1 to 1.3.

The method of this invention will be described below in greater detail with reference to the accompanying drawings in which.

Figure 3:
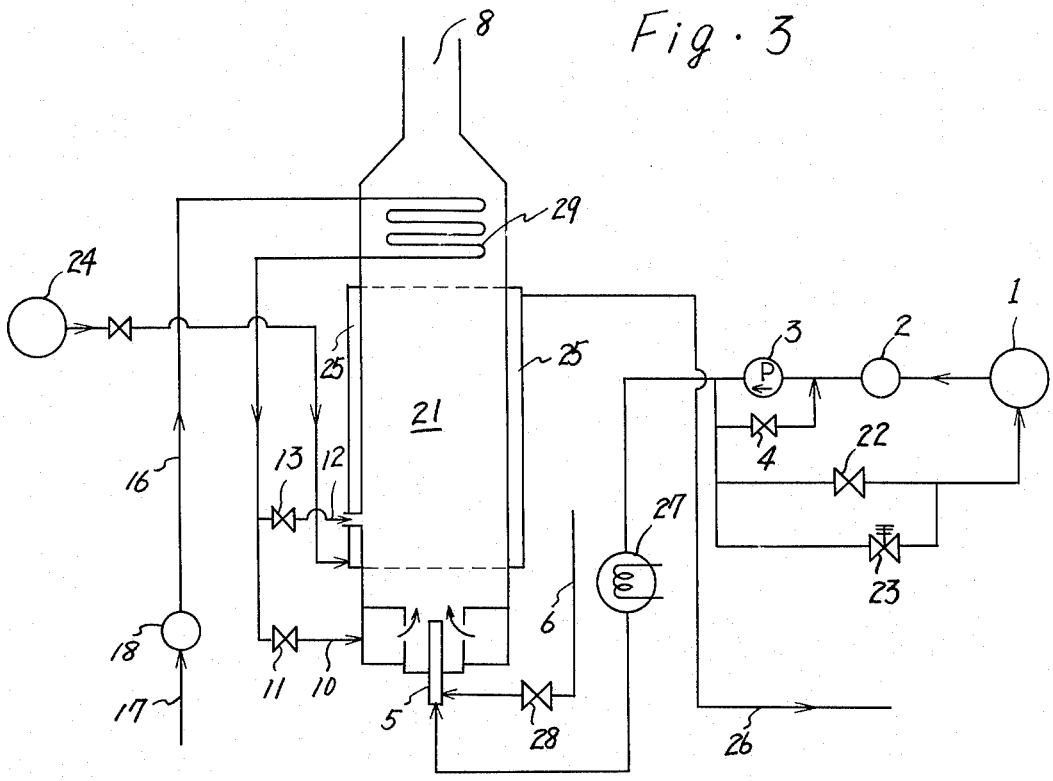
Figure 4:
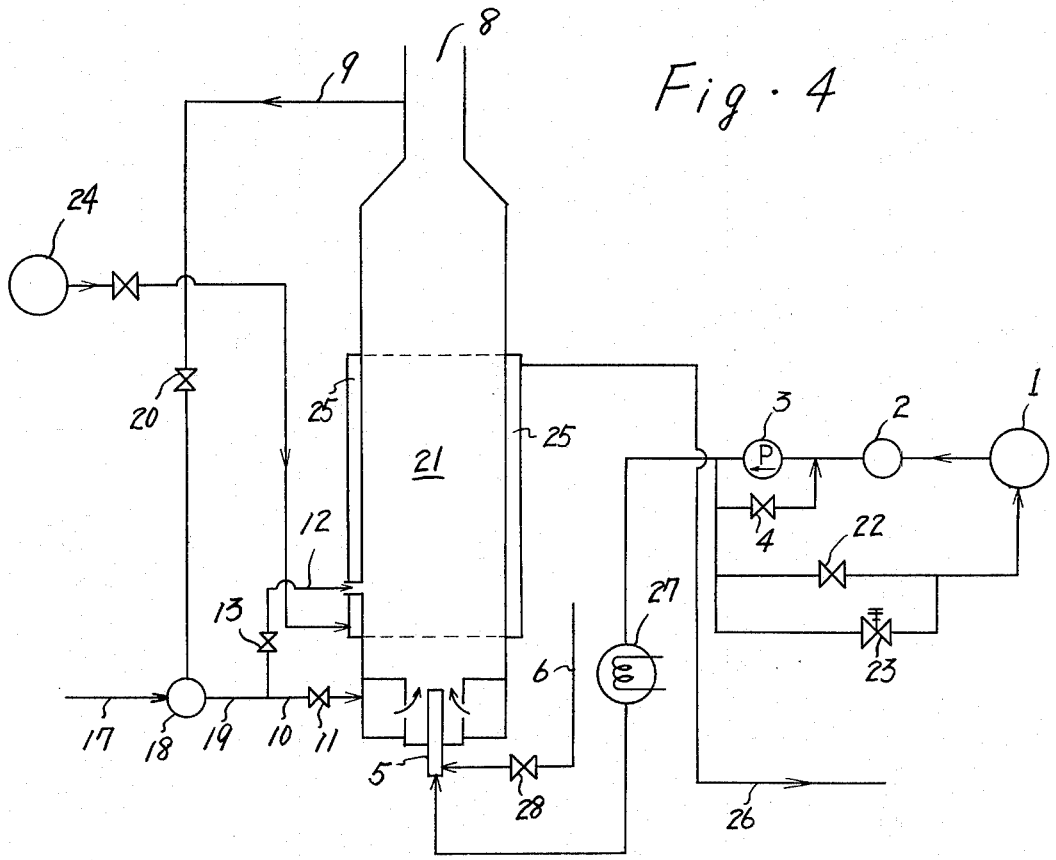

FIG. 3 is a flow chart schematically showing another preferred mode of practicing this invention by air atomizing combustion method using a water-cooled furnace in which emulsion oil is burned by two-stage combustion method; and FIG. 4 is a flow chart schematically showing another preferred mode of practicing this invention by air atomizing combustion method using a water-cooled furnace in which emulsion oil is burned by the combination of two-stage combustion method and exhaust gas recirculation method.

Figure 1:
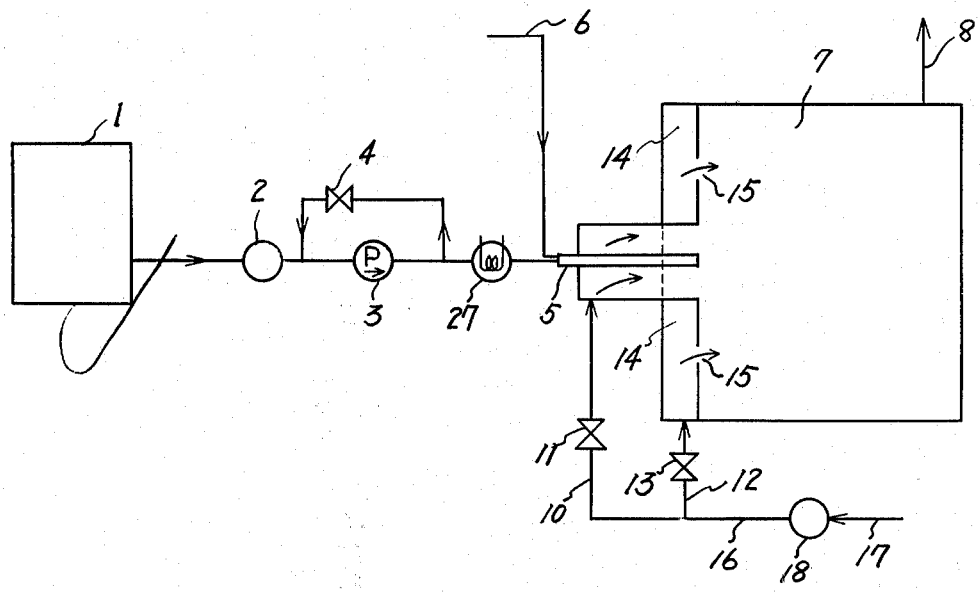
FIG. 1 is a flow chart schematically showing a preferred mode of this invention practiced in a steam boiler employing steam (or air) atomizing combustion method in which emulsion oil is burned by two-stage combustion method.

According to a mode of the invention shown in FIG. 1, emulsion oil is burned employing a boiler by two-stage combustion method. The emulsion oil placed in a storage tank 1 is passed through a strainer 2 to remove solid such as dust therefrom and then forced into an atomizer nozzle 5 by a pump, for example a gear pump 3. The emulsion oil is, if necessary, warmed by a heater (not shown) disposed in tank 1 to make transfer of the oil easy by reducing the viscosity thereof and further warmed by a heater 27 to improve combustion efficiency. The nozzle has a double construction. The emulsion oil is forced through the outer tube of the nozzle, while the steam supplied by way of an atomizing steam pipe 6 is passed through the inner tube of the nozzle at the same time and is jetted out into a combustion chamber 7 of a boiler. The jet of the steam drives the emulsion oil into the combustion chamber in atomized state for combustion. The flow rate of emulsion oil is adjusted by release valve 4 and the amount of steam to be used is controlled in corresponding relation to the flow rate of the emulsion oil by a suitable means, for example a steam valve (not shown). Combustion air is supplied through a line 17 by a fan 18 and sent to the combustion chamber 7 by way of a line 16. A portion of the combustion air is fed through a line 10 near to the front end of the atomizer nozzle 5 as primary air, and the remainder thereof is admitted through a line 12 into a compartment 14, from which it is introduced into the chamber 7 from an air inlet 15 as secondary air. The amounts of the primary air and secondary air are controlled by valves 11 and 13 respectively. The gas formed in the combustion chamber 7 is subjected to heat-exchange with water in a steam generator (not shown) and then exhausted into the atomosphere through an outlet 8.

Figure 2:
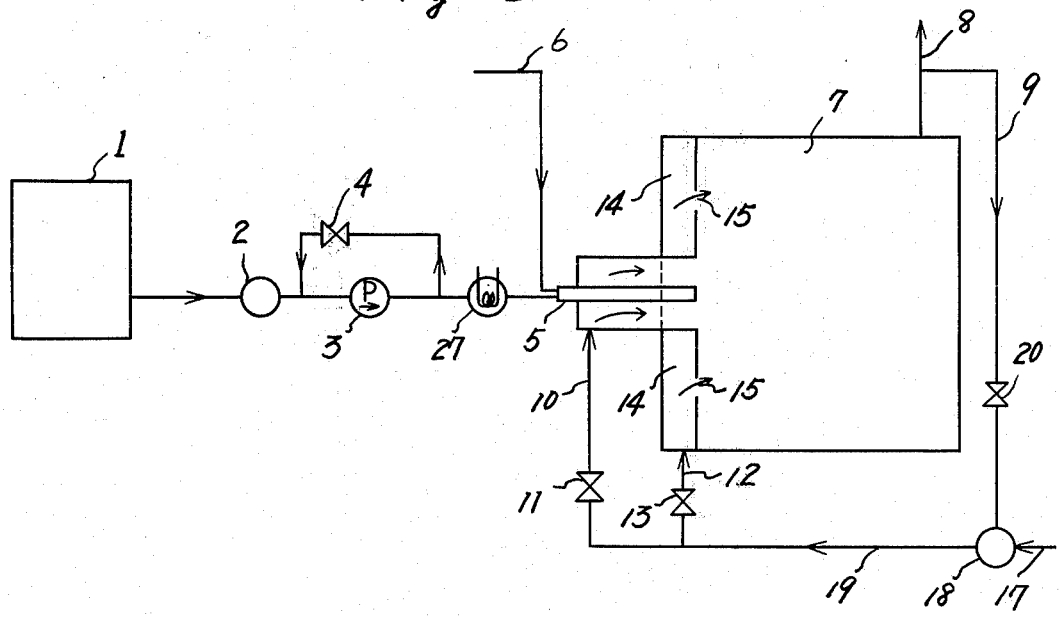
FIG. 2 is a flow chart schematically showing another preferred mode of this invention practiced in a steam boiler employing steam (or air) atomizing combustion method in which emulsion oil is burned by the combination of two-stage combustion method and exhaust gas recirculation method.

With reference to FIG. 2, emulsion oil is burned employing a boiler by the combination of two-stage combustion method and exhaust gas recirculation method. Indicated at 9 is an exhaust gas recycling line, at 20 an exhaust gas control valve and at 19 a combustion air line. Other like reference numerals designate like parts in FIG. 1. In FIG. 2, emulsion oil is burned by two-stage combustion method as described with reference to FIG. 1, but exhaust gas recirculation method is also employed in combination therewith. Exhaust gas is recirculated in the following manner. The gas resulting from combustion is discharged from an exhaust gas outlet 8 and part of it is guided through the exhaust gas recycling line 9 and returned to a combustion chamber 7 through a line 19 by a fan 18. The exhaust gas from the line 9 is mixed with fresh air admitted through a line 17, and the mixture, namely combustion air, is introduced into the combustion chamber 7 by way of the line 19. The amount of exhaust gas to be recycled is regulated by an exhaust gas control valve 20.

When air is used in place of atomizing steam, emulsion oil will be atomized with air.

According to another mode of the invention shown in FIG. 3, emulsion oil is burned by two-stage combustion method using a water-cooled furnace. The emulsion oil placed in a storage tank 1 is passed through a strainer 2 to remove solid such as dust therefrom and then forced into an atomizer nozzle 5 by a gear pump 3. The emulsion oil is warmed or preheated by a heater(not shown) disposed in the tank 1 and/or a heater 27, as required. The nozzle has a double construction. The emulsion oil is forced through the outer tube of the nozzle, while the air supplied by way of an atomizing air pipe 6 is passed through the inner tube of the nozzle at the same time and is jetted out into a furance 21. The jet of the air drives the emulsion oil into the furance 21 in atomized state for combustion. The flow rate of emulsion oil is adjusted by release valve 4 and the amount of air to be used is controlled by a valve 28. Indicated at 22 is a bypass valve and at 23 a relief valve.

Combustion air is supplied through a line 17 and is forced by a fan 18 through a line 16 into an air heater 29, disposed in the furnace 21, where the air is preheated. The preheating of the combustion air improves combustion efficiency. A portion of the combustion air is fed through a line 10 near to the front end of the atomizer nozzle 5 as primary air, and the remainder thereof is admitted through a line 12 as secondary air. The amounts of the primary air and secondary air are controlled by valves 11 and 13 respectively. The exhaust gas is discharged through an outlet 8. To cool the wall of the furnace 21, water is continuously supplied from a tank 24 into a jacket 25 and withdrawn therefrom through a line 26.

According to another preferred mode of the invention shown in FIG. 4, emulsion oil is burned by the combination of two-stage combustion method and exhaust gas recirculation method using a water-cooled furnace which is not equipped with a preheater for combustion air. Indicated at 9 is an exhaust gas recycling line, at 20 and exhaust gas control valve and at 19 a combustion air line. Other like reference numerals designate like parts in FIG. 3. In FIG. 4, emulsion oil is burned by two-stage combustion method as described with reference to FIG. 3, but exhaust gas recirculation method is also employed in combination therewith. Exhaust gas is recirculated in the similar manner as described in FIG. 2.

The combustion method of this invention assures a remarkable reduction in nitrogen oxide emissions and, at the same time, mitigating formation of soot to a negligible extent. The present method also has the advantage of being applicable to the incineration of waste oil or like flammable oily refuse when such refuse is used as oil for combustion.

Examples of this invention are given below in which parts are all by volume. Throughout the examples, oils are generally atomized at room temperature, except for fuel oil — C and the emulsion thereof which are atomized at 90° ± 5°C. The nitrogen oxide concentration of the exhaust gas is determined by constant-potential electrolysis method unless otherwise specified. The amount of soot is determined by the dust tube method specified by JIS Z 8808 or with the unaided eye.

EXAMPLE 1

Fuel oil — C (sulfur content: 2.5 wt.%), containing 0.05 vol. % of surfactant (sorbitan monolaurate) dissolved therein, and water are fed to a homo-mixer in a ratio of 800 parts of the fuel oil to 200 parts of water to prepare an emulsion oil of the water-in-oil type containing water particles of about 3 microns in mean size.

The emulsion oil is burned by two-stage combustion method (hereinafter referred to briefly as "TSC method") according to FIG. 1 at a rate of 1,750 to 1,760 *l*/hr. in terms of the amount of the oil component of the emulsion oil (the term "*l*/hr." has the same meaning hereinafter), using a boiler having a capacity of 30 *t*/hr. and equipped with a burner of the steam-atomizing type, with marked reductions achieved in soot and nitrogen oxide emissions. The results and combustion conditions are listed in Table 1, which, for comparison, also indicates the results obtained by burning the same emulsion oil according to usual combustion method (hereinafter referred to briefly as "usual method") and by burning the fuel oil — C according to TSC method and usual method. In Example 1 and Examples 2 to 5 to follow, the term "usual method" means a combustion method in which combustion air is used wholly as primary air, with the valve 13 in FIG. 1 closed. In Table 1 and throughout the following tables, the term "primary air ratio" means the ratio of the amount of primary air to the theoretically required amount of air; the term "secondary air ratio" similarly means the ratio of the amount of secondary air to the theoretically required amount of air; and nitrogen oxide emissions are referred to as "$NO_x$".

Table 1

| | No. | Combustion method | Oil | Primary air ratio | Secondary air ratio | $NO_x$ (p.p.m.) | Soot* (g/Nm³) |
|---|---|---|---|---|---|---|---|
| The invention | 1 | TSC | Emulsion | 0.6 | 0.6 | 165 | 0.076 |
| | 2 | " | " | 0.42 | 0.78 | 145 | 0.095 |
| Comparison | 3 | Usual | " | 1.2 | 0 | 263 | 0.055 |
| | 4 | TSC | Fuel oil-C | 0.6 | 0.6 | 177 | 0.320 |
| | 5 | " | " | 0.42 | 0.78 | —** | —** |
| | 6 | Usual | " | 1.2 | 0 | 286 | 0.108 |

Note:
*Determined according to JIS Z 8808.
**Combustion has been stopped within a short time because flame became too elongated for the limited space in the combustion chamber.

EXAMPLE 2

Fuel oil — A (sulfur content: 0.8 wt. %), containing 0.2 vol. % of surfactant (sorbitan monostearate) dissolved therein, and water are fed to a homo-mixer in a ratio of 800 parts of the fuel oil to 200 parts of water to prepare an emulsion oil of the water-in-oil type containing water particles of about 3 microns in mean size and having a viscosity of 7 cps. (at 20°C).

The emulsion oil is burned by TSC method according to FIG. 1 at a rate of 1,750 to 1,800 *l*/hr., using a boiler having a capacity of 30 *t*/hr. and equipped with a burner of the steam-atomizing type, with marked reductions achieved in soot and nitrogen oxide emissions. The results and combustion conditions are listed in Table 2, which, for comparison, also gives the result obtained by burning the fuel oil — A according to TSC method and usual method.

Table 2

| | No. | Combustion method | Oil | Primary air ratio | Secondary air ratio | $NO_x$ (p.p.m.) | Soot* (g/Nm³) |
|---|---|---|---|---|---|---|---|
| The invention | 1 | TSC | Emulsion | 0.6 | 0.6 | 35 | 0.043 |
| Comparison | 2 | TSC | Fuel oil - A | 0.6 | 0.6 | 48 | 0.150 |
| | 3 | Usual | " | 1.2 | 0 | 90 | 0.053 |

Note: *Same as in Table 1.

EXAMPLE 3

Fuel oil — C (sulfur content: 2.3 wt.%), containing 0.01 vol. % of surfactant (sorbitan monooleate) dissolved therein, and water are fed to a homo-mixer in a ratio of 800 parts of the fuel oil to 200 parts of water to prepare an emulsion oil of the water-in-oil type containing water particles of about 2 microns in mean size.

The emulsion oil is burned by TSC method according to FIG. 3 at a rate of 18 to 22 *l*/hr., using a water-cooled furnace equipped with a burner of the air-atomizing type, with marked reductions achieved in soot and nitrogen oxide emissions. The results and combustion conditions are listed in Table 3, which, for comparison, also shows the results obtained by burning the same emulsion oil according to usual method and by burning the fuel oil — C according to TSC method and usual method.

Table 3

| | No. | Combustion method | Oil | Primary air ratio | Secondary air ratio | $NO_x$ (p.p.m.) | Soot** |
|---|---|---|---|---|---|---|---|
| The invention | 1 | TSC | Emulsion | 0.9 | 0.3 | 170 | A-B |
| | 2 | " | " | 1.0 | 0.2 | 205 | A |
| Comparison | 3 | Usual | " | 1.2 | 0 | 220 | A |
| | 4 | TSC | Fuel oil - C | 0.9 | 0.3 | 205* | C |
| | 5 | " | " | 1.0 | 0.2 | 240* | B |
| | 6 | " | " | 1.1 | 0.1 | 265 | A |
| | 7 | Usual | " | 1.2 | 0 | 265 | A |

Note:
*Determined by chemical luminescence method.
**Determined with the unaided eye according to the following criteria:
A: No soot is emitted from the outlet 8.
B: A small amount of soot is emitted from the outlet 8.
C: A fairly large amount of soot is emitted from the outlet 8.

The table indicates that with the amount of primary air which permits formation of soot in burning the fuel oil — C, the emulsion oil can be burned with the formation of soot reduced to a negligible extent, and that when burned by TSC method, the emulsion oil results in a greater reduction of nitrogen oxide emissions than fuel oil — C.

EXAMPLE 4

Kerosene and an aqueous solution containing 1 vol. % of surfactant (polyoxyethylene lauryl ether, HLB=17) dissolved therein are continuously fed to a homo-mixer in a ratio of 700 parts of kerosene to 300 parts of the solution to prepare an emulsion oil of the oil-in-water type containing oil particles of about 4 microns in mean size and having a viscosity of 65 cps. (at 23°C).

The emulsion oil is burned by TSC method in the same manner as in Example 3, using a water-cooled furnace equipped with a burner of the air-atomizing type, with marked reductions achieved in soot and nitrogen oxide emissions. The results and combustion conditions are listed in Table 4, which, for comparison, also gives the results obtained by burning the same emulsion oil according to usual method and by burning kerosene according to TSC method and usual method.

Table 4

| | No. | Combustion method | Oil | Primary air ratio | Secondary air ratio | $NO_x$ (p.p.m.) | Soot** |
|---|---|---|---|---|---|---|---|
| The invention | 1 | TSC | Emulsion | 0.9 | 0.25 | 48 | A-B |
| | 2 | " | " | 1.0 | 0.15 | 67 | A |
| Comparison | 3 | Usual | " | 1.15 | 0 | 80 | A |
| | 4 | TSC | Kerosene | 0.9 | 0.25 | 78* | C |
| | 5 | " | " | 1.0 | 0.15 | 115* | B |
| | 6 | Usual | " | 1.15 | 0 | 120 | A |

Note:
*Determined by chemical luminescence method.
**Same as in Table 3.

EXAMPLE 5

Fuel oil — C (sulfur content: 2.3 wt. %) and water which are heated to about 50°C are continuously fed to a homo-mixer in the ratio listed in Table 6 to prepare an emulsion oil of the water-in-oil type. The emulsion oil is immediately burned by TSC method in the same manner as in Example 3, using water-cooled furnace equipped with a burner of the air-atomizing type, with a marked reduction achieved in soot. The results and combustion conditions are given in Table 5, which, for comparison, also gives the results obtained by burning the fuel oil — C according to TSC method.

Table 5

| | No. | Combustion method | Oil | Primary air ratio | Secondary air ratio | Soot* |
|---|---|---|---|---|---|---|
| The invention | 1 | TSC | Emulsion (Fuel oil - C/water= 90/10 by vol.) | 0.9 | 0.3 | A-B |
| | 2 | " | Emulsion (Fuel oil - C/water= 80/20 by vol.) | " | " | A-B |
| | 3 | " | Emulsion (Fuel oil - C/water= 60/40 by vol.) | " | " | A-B |
| Comparison | 4 | " | Fuel oil - C | " | " | C |

Note: *Same as in Table 3.

EXAMPLE 6

Fuel oil — C (sulfur content: 2.3 wt. %), containing 0.1 vol. % of surfactant (sorbitan sesquioleate) dissolved therein, and water are fed to a homo-mixer in a ratio of 800 parts of the fuel oil to 200 parts of water to prepare an emulsion oil of the water-in-oil type.

The emulsion oil is burned by TSC method according to FIG. 1 or the combination of this method and exhaust gas recirculation method (hereinafter referred to briefly as "EGR method") according to FIG. 2 at a rate of 1,750 to 1,760 *l*/hr., using a boiler having a capacity of 30 *t*/hr. and equipped with a burner of the steam-atomizing type, with marked reductions achieved in soot and nitrogen oxide emissions. The results and combustion conditions are listed in Table 6, which, for comparison, also gives the results obtained by burning the same emulsion oil according to usual method, by burning the fuel oil — C according to TSC method, by burning the fuel oil — C according to the combination of TSC method and EGR method and by burning the fuel oil — C according to usual method. In Example 6, the term "usual method" means a combustion method in which combustion air is used wholly as primary air by closing the valve 13 in FIG. 1.

Table 6

| | No. | Combustion method | Oil | Primary air ratio | Secondary air ratio | Amount of exhaust gas recirculated (vol.%) | $NO_x$ (p.p.m.) | Soot* (g/Nm³) |
|---|---|---|---|---|---|---|---|---|
| The invention | 1 | TSC | Emulsion | 0.6 | 0.6 | 0 | 165 | 0.076 |
| | 2 | TSC+EGR | " | 0.6 | 0.6 | 15 | 155 | 0.062 |
| Comparison | 3 | Usual | " | 1.2 | 0 | 0 | 263 | 0.055 |
| | 4 | TSC | Fuel oil - C | 0.6 | 0.6 | 0 | 177 | 0.320 |
| | 5 | TSC+EGR | " | 0.6 | 0.6 | 15 | 162 | 0.215 |
| | 6 | Usual | " | 1.2 | 0 | 0 | 286 | 0.108 |

Note: *Same as in Table 1.

EXAMPLE 7

Fuel oil — C (sulfur content: 2.3 wt.%), containing 0.01 vol. % of surfactant (sorbitan monolaurate) dissolved therein, and water are fed to a homo-mixer in a ratio of 800 parts of the fuel oil to 200 parts of water to prepare an emulsion oil of the water-in-oil type containing water particles of about 2 microns in mean size.

The emulsion oil is burned by TSC method according to FIG. 3 or the combination of this method and EGR method according to FIG. 4 at a rate of 18 to 22 *l*/hr., using a water-cooled furnace equipped with a burner of the air-atomizing type, with marked reductions achieved in soot and nitrogen oxide emissions. The results and combustion conditions are listed in Table 7, which, for comparison, also gives the results obtained by burning the same emulsion oil according to usual method, by burning the fuel oil — C according to TSC method and by burning the fuel oil — C according to usual method. In example 7 and the following Example 8, the term "usual method" means a combustion method in which combustion air is used wholly as primary air by closing the valve 13 in FIG. 3.

Table 7

| | No. | Combustion method | Oil | Primary air ratio | Secondary air ratio | Amount of exhaust gas re-circulated (vol.%) | $NO_x$ (p.p.m.) | Soot** |
|---|---|---|---|---|---|---|---|---|
| The invention | 1 | TSC | Emulsion | 0.9 | 0.3 | 0 | 135 | A-B |
| | 2 | " | " | 1.0 | 0.2 | 0 | 160 | A |
| | 3 | TSC+EGR | " | 0.9 | 0.3 | 20 | 110 | A |
| Comparison | 4 | Usual | " | 1.2 | 0 | 0 | 205 | A |
| | 5 | TSC | Fuel oil - C | 0.9 | 0.3 | 0 | 170* | C |
| | 6 | " | " | 1.0 | 0.2 | 0 | 185* | B |
| | 7 | " | " | 1.1 | 0.1 | 0 | 205 | A |
| | 8 | Usual | " | 1.2 | 0 | 0 | 235 | A |

Note:
*Determined by chemical luminescence method.
**Same as in Table 3.

EXAMPLE 8

Kerosene and an aqueous solution containing 0.5 vol. % of surfactant (polyoxyethylene lauryl ether, HLB=17) dissolved therein are continuously fed to a homo-mixer in a ratio of 600 parts of kerosene to 400 parts of the solution to prepare an emulsion oil of the oil-in-water containing oil particles of about 3 microns in mean size and having a viscosity of 35 cps. (at 23°C).

The emulsion oil is burned by TSC method according to FIG. 3 or the combination of this method and EGR method according to FIG. 4 at a rate of 18 to 22 *l*/hr., using a water-cooled furnace equipped with a burner of the air-atomizing type, with marked reductions achieved in soot and nitrogen oxide emissions. The results and combustion conditions are listed in Table 8, which, for comparison, also gives the results obtained by burning the same emulsion oil according to usual method, by burning kerosene according to TSC method and by burning kerosene according to usual method.

Table 8

| | No. | Combustion method | Oil | Primary air ratio | Secondary air ratio | Amount of exhaust gas re-circulated (vol.%) | $NO_x$ (p.p.m.) | Soot** |
|---|---|---|---|---|---|---|---|---|
| The invention | 1 | TSC | Emulsion | 0.9 | 0.25 | 0 | 32 | A-B |
| | 2 | TSC+EGR | " | 0.9 | 0.25 | 20 | 18 | A |
| Comparison | 3 | Usual | " | 1.15 | 0 | 0 | 52 | A |
| | 4 | TSC | Kerosene | 0.9 | 0.25 | 0 | 60* | C |
| | 5 | Usual | " | 1.15 | 0 | 0 | 107 | A |

Note:
*Determined by chemical luminescence method.
**Same as in Table 3.

What is claimed is:

1. In burning an emulsion oil containing oil and water in a ratio of 5 – 9.5 : 5 – 0.5 by volume, a method characterized in that the emulsion oil is burned with 30 to 105 vol. % of primary air and 15 to 200 vol. % of secondary air based on the theoretically required amount of air, the amount of total combustion air being 100 to 300 vol. % based on the theoretically required amount of air.

2. The method as set forth in claim 1 wherein the amounts of said primary, secondary and total air are 40 to 90 vol. %, 25 to 100 vol. % and 110 to 190 vol. % based on the theoretically required amount of air, respectively.

3. The method as set forth in claim 2 wherein the amount of said total air is 110 to 130 vol. % based on the theoretically required amount of air.

4. The method as set forth in claim 1 wherein the water contained in the emulsion oil is replaced by at least one aliphatic alcohol having 1 to 3 carbon atoms in the range of up to 10% by volume based on the water.

5. The method as set forth in claim 4 wherein said aliphatic alcohol is at least one of methanol, ethanol and propanol.

6. The method as set forth in claim 4 wherein the amount of alcohol is in the range of 0.01 to 3% by volume based on the water contained in the emulsion oil.

7. The method as set forth in claim 1 wherein said emulsion oil contains a surfactant in the range of 0.01 to 5% by volume based on the emulsion oil.

8. The method as set forth in claim 7 wherein said surfactant consists of carbon, hydrogen and oxygen atoms.

9. In burning an emulsion oil containing oil and water in a ratio of 5 – 9.5 : 5 – 0.5 by volume, a method characterized by burning the emulsion oil with 30 to 105 vol. % of primary air and 15 to 200 vol. % of secondary air based on the theoreticallly required amount of air, the amount of total combustion air being 100 to 300 vol. % based on the theoretically required amount of are while recirculating 10 to 40 vol. % of the resulting combustion exhaust gas to a combustion chamber.

10. The method as set forth in claim 9 wherein the amounts of said primary, secondary and total air are 40 to 90 vol. %, 25 to 100 vol. % and 110 to 190 vol. % based on the theoretically required amount of air, respectively and the amount of said combustion exhaust gas to be recirculated is 15 to 30 vol. %.

11. The method as set forth in claim 10 wherein the amount of said total air is 110 to 130 vol. % based on the theoretically required amount of air.

12. The method as set forth in claim 9 wherein the water contained in the emulsion oil is replaced by at least one aliphatic alcohol having 1 to 3 carbon atoms in the range of up to 10% by volume based on the water.

13. The method as set forth in claim 12 wherein said aliphatic alcohol is at least one of methanol, ethanol and propanol.

14. The method as set forth in claim 12 wherein the amount of alcohol is in the range of 0.01 to 3% by volume based on the water contained in the emulsion oil.

15. The method as set forth in claim 9 wherein said emulsion oil contains a surfactant in the range of 0.01 to 5% by volume based on the emulsion oil.

16. The method as set forth in claim 15 wherein said surfactant consists of carbon, hydrogen and oxygen atoms.

* * * * *